US006466110B1

(12) United States Patent
Wulff et al.

(10) Patent No.: US 6,466,110 B1
(45) Date of Patent: Oct. 15, 2002

(54) TAPERED COAXIAL RESONATOR AND METHOD

(75) Inventors: Torsten R. Wulff, Medford; Shawn A. Hogan, Gold Hill, both of OR (US)

(73) Assignee: Kathrein Inc., Scala Division, Medford, OR (US)

( * ) Notice: Subject to any disclaimer, the term of this patent is extended or adjusted under 35 U.S.C. 154(b) by 0 days.

(21) Appl. No.: 09/705,439

(22) Filed: Nov. 3, 2000

Related U.S. Application Data

(60) Provisional application No. 60/169,190, filed on Dec. 6, 1999.

(51) Int. Cl.[7] ..... H01P 7/04

(52) U.S. Cl. ..... 333/222; 333/206

(58) Field of Search ..... 333/222, 223, 333/224, 225, 226, 206, 207, 81 A, 203

(56) References Cited

U.S. PATENT DOCUMENTS

| | | | | | |
|---|---|---|---|---|---|
| 2,566,050 | A | * | 8/1951 | Wolf | 333/226 |
| 4,091,337 | A | | 5/1978 | Heckman, Jr. | 331/101 |
| 4,207,548 | A | | 6/1980 | Graham et al. | 333/225 |
| 4,292,610 | A | | 9/1981 | Makimoto et al. | 333/222 |
| 4,423,398 | A | * | 12/1983 | Jachowski et al. | 333/229 |
| 4,477,786 | A | * | 10/1984 | Tamura et al. | 333/207 |
| 4,754,242 | A | | 6/1988 | Okamura et al. | 333/175 |
| 4,775,847 | A | * | 10/1988 | Epsom et al. | 333/226 |
| 4,933,652 | A | | 6/1990 | Gaukel | 333/225 |
| 5,179,074 | A | * | 1/1993 | Fiedziuszko et al. | 505/1 |
| 5,304,968 | A | | 4/1994 | Ohtonen et al. | 333/222 |
| 5,754,084 | A | | 5/1998 | Hietala | 333/229 |
| 5,894,250 | A | | 4/1999 | Ravaska et al. | 333/134 |
| 5,990,763 | A | * | 11/1999 | Sipila | 333/202 |

* cited by examiner

*Primary Examiner*—Benny Lee
*Assistant Examiner*—Stephen E. Jones
(74) *Attorney, Agent, or Firm*—Dorsey & Whitney LLP

(57) ABSTRACT

A coaxial cavity resonator is described. The resonator includes a tapered inner conductor for increasing the Q of the cavity.

5 Claims, 2 Drawing Sheets

TAPERED COAXIAL RESONATOR AND METHOD

RELATED APPLICATIONS

This application claims priority to Provisional Application Ser. No. 60/169,190 filed Dec. 6, 1999.

BRIEF DESCRIPTION OF THE INVENTION

This invention relates generally to a coaxial resonator and more particularly to a coaxial resonator having an increased electrical Q for a given size and to a method for increasing the electrical Q of a coaxial resonator.

BACKGROUND OF THE INVENTION

An RF resonant cavity (or multiple interconnected cavities) can be used to create a RF filter. The filter may either pass a RF signal over a limited frequency range (a bandpass filter) or exclude an RF signal over a limited frequency range (a notch or band stop filter), depending upon how the resonator is connected to the overall system. A perfect single cavity device would operate at a single, specific frequency (the resonant frequency), however due to material and other considerations all resonant frequency devices operate over a frequency range which encompasses the resonant frequency.

An RF resonator is realized by having a conductive post within an enclosed conductive cavity. The post is connected to the bottom of the cavity and extends towards the top of the cavity. The cavity is formed within a conductive housing and enclosed by a conductive lid. The resonant frequency of the cavity is selected by adjusting the length of the post.

The electrical Q of a coaxial resonator is a measure of its performance. As mentioned previously, a perfect single resonator would operate at a single specific frequency. However, due to material and other considerations all resonant frequency devices operate over limited frequency range. The electrical Q of the resonator is determined by the width of the frequency range, see FIG. 1. The higher the Q, Trace 1, the narrower the frequency range as compared to a lower Q. As is generally known, the larger the size of a cavity, the higher its Q.

Because the frequency response of a single resonant cavity is very narrow and a practical device must operate over a wide frequency range, it is necessary to combine multiple cavities to achieve a desired frequency range. In addition, the rate at which a multi-cavity filter makes the transition between passing a signal and blocking a signal (the steepness of the filter curve flange) is a function of the number and size of the cavities in the multi-cavity filter. The greater the number of cavities the sharper the transition. An ideal multi-cavity filter would have a vertical (or near vertical) edge. U.S. Pat. No. 5,894,250 describes a cavity resonator filter employing multiple cavities. The physical size of the filter is achieved by employing a combination of larger volume high Q and smaller volume low Q cavities to significantly reduce insertion loss and provide a compact filter.

The steepness of the filter curve flange is also a function of the electrical Q of the individual resonant cavities comprising the filter. The higher the electrical Q at a given insertion loss, the steeper the filter curve flange. Therefore, if the electrical Q of the individual cavities is improved, it is possible to realize a given multi-cavity filter response using smaller cavities resulting in a reduced overall device size.

OBJECTS AND SUMMARY OF THE INVENTION

It is an object of the present invention to provide a coaxial resonant cavity having a high electrical Q.

It is another object of the present invention to provide a method of increasing the electrical Q of a cavity of a given size.

It is a further object of the present invention to provide a band pass filter including a plurality of high Q cavities incorporating the present invention.

The foregoing and other objects of the invention are achieved by a coaxial resonator of the type including a conductive cavity having bottom, top and side walls with an inner conductor or stub having one end in a short circuit connection with the bottom wall and its other end in open circuit relationship with and spaced from the top wall characterized in that the inner conductor or stub tapers outwardly at the one end.

DETAILED DESCRIPTION OF THE INVENTION

Figure 1:
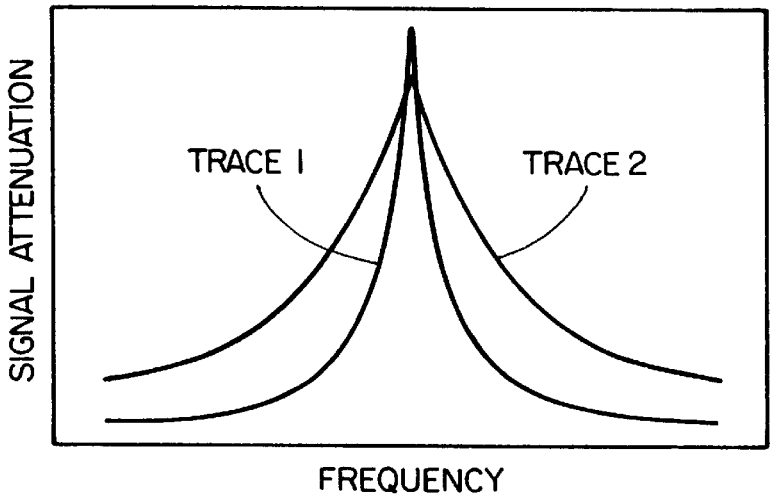
FIG. 1 shows the frequency response of two cavities having different electrical Qs.
Figure 2:
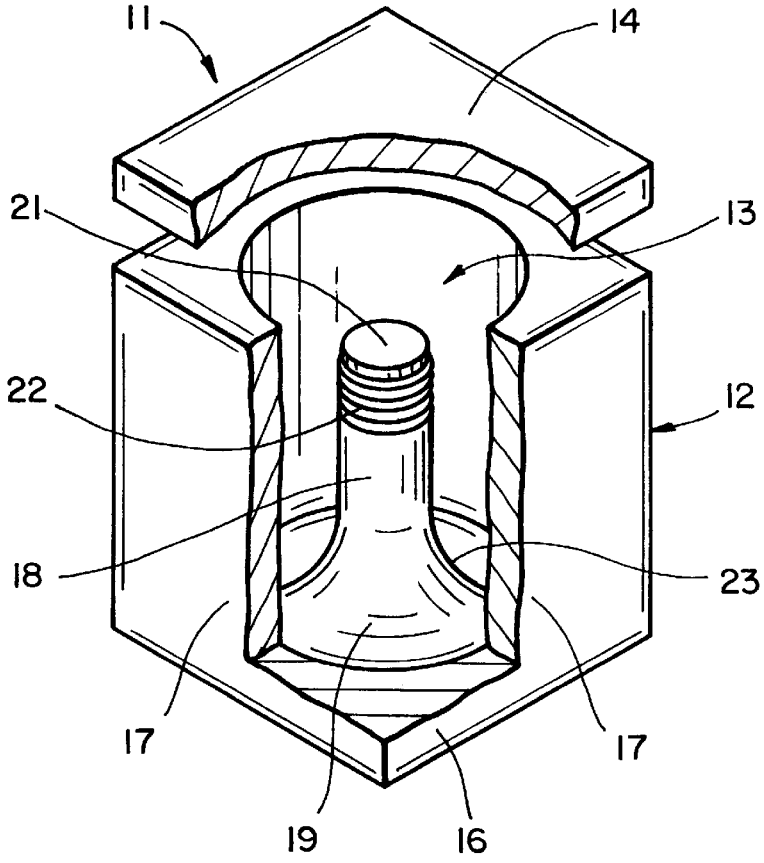
FIG. 2 schematically shows a coaxial resonator.

FIG. 2 schematically shows a coaxial resonator 11. The resonator includes a housing 12 made of conductive material such as aluminum defining a cavity 13. It is well known that the housing and cavity can have various shapes. The housing includes a top 14 and bottom 16 and side wall or walls 17 forming the enclosure or cavity 13. A central conductor, post or stub 18 is disposed axially within the cavity with its lower end 19 in conductive contact with the bottom 16 of the housing 12. The other end of the central conductor is spaced from the top 14. The length of the central conductor and therefore the resonant frequency can be adjusted by a screw (not shown) engaging the top 21 attached to bellows 22. As is well known, the resonant frequency of the cavity depends upon the size of the cavity and the spacing between the top 21 of the center or inner conductor 18 and housing top 14. The electrical Q of the cavity is dependent on the size of the cavity.

Another feature influencing the electrical Q of the resonant cavity is its characteristic impedance. The highest electrical Q is obtained when the characteristic impedance between the inner conductor or stub ranges from zero at the base of the inner conductor, to infinity at the tip of the inner conductor. The ideal impedance characteristics are shown by the curve 20 in FIG. 3.

Figure 3:
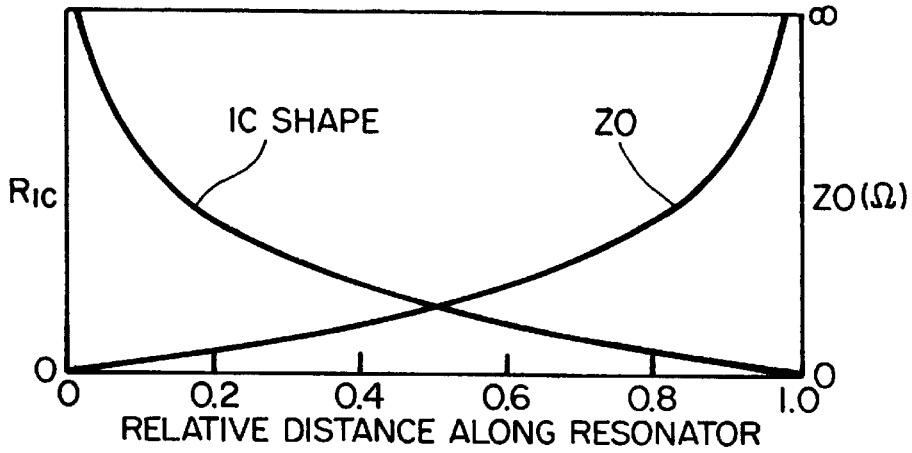
FIG. 3 shows the impedance along a central conductor or stub and the corresponding ideal shape for maximizing the electrical Q of the cavity.

The ideal shape of the inner conductor (IC) would be the mirror image of the impedance plot. The inner conductor would slope from the outer diameter of the cavity 13 at its lower end to a sharp point at its upper end. The curve marked 1C Shape in FIG. 3 shows the general form for the ideal inner conductor. Another way of describing the inner conductor would be to state that it tapers outwardly from the upper end to the lower end. A sharp point which represents the ideal is undesirable from a voltage stability perspective. Furthermore, the shape would be impractical to manufacture.

In accordance with the present invention, there is provided an inner conductor shape that substantially increases the electrical Q while remaining easy to manufacture. Several shapes were tested and found to improve the electrical Q. The preferred inner conductor tapers in a smooth curve 23 outwardly along the bottom of the cavity, FIG. 2. Up to a certain limit, as the radius of the curve 23 of the bottom 19 is increased, the electrical Q increases.

Figure 4:
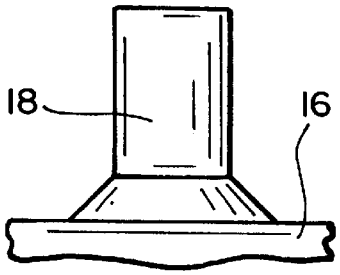
FIG. 4 shows a coaxial resonator with a central conductor or stub with a smooth straight taper at the lower end.
Figure 5:
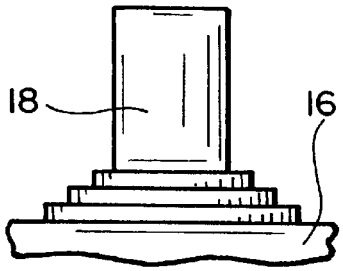
FIG. 5 shows a coaxial resonator with a central conductor or stub with a stepped taper at the lower end.

In one example, a coaxial resonant cavity having the overall dimensions 45.8×45.8 mm was operated at a frequency of 2.706 GHz. Central posts with tapered radii 6.35 mm and 5.56 mm were tested and the unloaded Q was found to increase from 4759 for central conductor without taper to 5870 and 5259 for tapered central posts of ratio 12.8 mm. This clearly shows that the unloaded Q of a resonant cavity can be significantly increased by tapering the lower end of the central conductor outwardly. The unloaded Q can also be increased by using a straight taper, FIG. 4, or a stepped taper, FIG. 5.

In addition, the inner conductor is preferably formed as an integral part of the cavity by milling the inner conductor or stub 18 from the same material as the bottom of the cavity, eliminating any contact resistance that would occur if the inner conductor were a separate piece. The elimination of this contact surface improves the electrical Q of the resonant cavity. Finally, practical devices feature a coating of a high conductivity material (e.g., silver) applied to the inner surface of the cavity. The elimination of the sharp transition between the base of the inner conductor and the cavity bottom results in a more uniform plating thickness, and improved overall performance.

Figure 6:
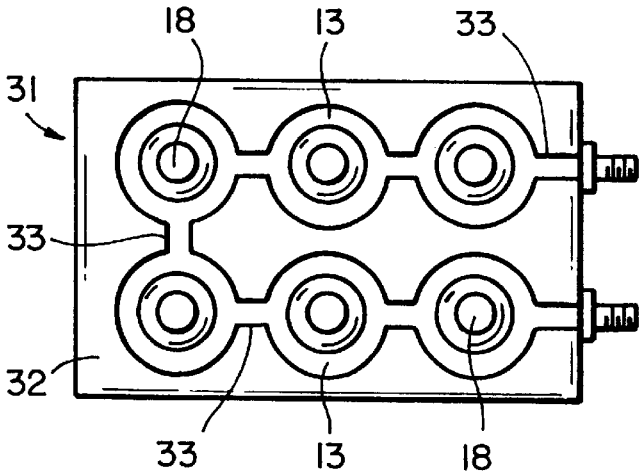
FIG. 6 is a top plan view of a multi-cavity filter incorporating the present invention.

FIG. 6 schematically shows a top view of a plurality of cavity resonators 11 in accordance with the present invention connected in series to form a filter 31. The filter includes a body 32 having a plurality of cavities 13 interconnected by irises 33. The cavities include center posts or conductors 18 in accordance with the present invention. By using resonators in accordance with the present invention, the filter can be more compact.

While the invention is susceptible to various modifications and alternative forms, specific embodiments thereof have been shown by way of example in the drawings and described above. It should be understood, however, that the detailed description is not intended to limit the invention to the particular forms disclosed. On the contrary, the intention is to cover all modifications, equivalents, and alternatives falling within the spirit and scope of the invention as defined by the appended claims.

What is claimed is:

1. A coaxial cavity resonator including a conductive cavity with top and bottom walls and side walls with an inner conductor spaced from said side walls having one end in a short circuit connection with the bottom wall and having its other end in open-circuit relationship with and spaced from the top wall characterized in that the inner conductor tapers outwardly at the one end such that the tapering follows the shape of an impedance curve for an ideal inner conductor.

2. A coaxial cavity resonator as in claim 1 in which the other end is formed into an end that is not sharp.

3. A coaxial cavity resonator as in claim 1 in which the inner conductor is formed integral with the bottom wall of the cavity.

4. A coaxial cavity resonator as in claim 3 in which the internal surfaces of the cavity are plated with a high conductivity film.

5. A coaxial cavity resonator as in claim 3 in which the inner conductor is formed by milling the inner conductor from the same material as the bottom of the cavity such that contact resistance between the inner conductor and the bottom of the cavity is eliminated.

* * * * *